US008156872B2

(12) United States Patent
Hathaway et al.

(10) Patent No.: US 8,156,872 B2
(45) Date of Patent: Apr. 17, 2012

(54) SYSTEM, NETWORK AND METHOD FOR TRANSPORTING CARGO

(75) Inventors: Richard C. Hathaway, Greenville, OH (US); M. Kent Bridges, New Madison, OH (US)

(73) Assignee: KACI Intermodal Systems, LLC, Greenville, OH (US)

( * ) Notice: Subject to any disclaimer, the term of this patent is extended or adjusted under 35 U.S.C. 154(b) by 321 days.

(21) Appl. No.: 12/477,295

(22) Filed: Jun. 3, 2009

(65) Prior Publication Data

US 2009/0293756 A1 Dec. 3, 2009

Related U.S. Application Data

(60) Provisional application No. 61/130,940, filed on Jun. 3, 2008, provisional application No. 61/188,622, filed on Aug. 11, 2008.

(51) Int. Cl.
*B61B 1/00* (2006.01)

(52) U.S. Cl. ..... 104/29; 104/27; 104/30; 104/31

(58) Field of Classification Search ..... 104/27, 104/29, 30, 31; 414/339, 396, 401, 584
See application file for complete search history.

(56) References Cited

U.S. PATENT DOCUMENTS

| | | | | |
|---|---|---|---|---|
| 1,789,436 | A * | 1/1931 | Hegel | 104/29 |
| 2,107,292 | A * | 2/1938 | Fitch | 414/342 |
| 2,896,548 | A * | 7/1959 | Obes | 104/48 |
| 3,091,188 | A * | 5/1963 | Graham | 104/29 |
| 5,836,251 | A * | 11/1998 | Hathaway et al. | 104/27 |
| 5,901,649 | A * | 5/1999 | Hathaway et al. | 104/29 |
| 6,401,624 | B1 * | 6/2002 | Nijenhuis | 104/29 |
| 6,439,128 | B1 * | 8/2002 | Miller et al. | 104/27 |
| 2005/0126426 | A1 * | 6/2005 | Forbes | 105/355 |
| 2008/0141895 | A1 * | 6/2008 | Lanigan et al. | 104/29 |
| 2009/0293756 | A1 * | 12/2009 | Hathaway et al. | 104/29 |

* cited by examiner

*Primary Examiner* — S. Joseph Morano
*Assistant Examiner* — Jason C Smith
(74) *Attorney, Agent, or Firm* — James Ray & Assoc

(57) ABSTRACT

A system for transporting cargo includes a cargo terminal having a pair of longitudinal sides, at least one of the pair of longitudinal sides disposed adjacent to and spaced a predetermined distance from a railway track and at least one railcar positioned at a predetermined acute angle relative to the at least one of the pair of longitudinal sides of the cargo terminal and having one end thereof disposed in close proximity thereto so as to enable loading or unloading such cargo through such one end of such at least one railcar. A network of at least two cargo terminals and a method of intermodal cargo transporting are also provided.

14 Claims, 13 Drawing Sheets

SYSTEM, NETWORK AND METHOD FOR TRANSPORTING CARGO

CROSS-REFERENCE TO RELATED APPLICATIONS

This application is related to and claims priority from U.S. Provisional Patent Application Ser. No. 61/130,940 filed on Jun. 3, 2008 and U.S. Provisional Patent Application Ser. No. 61/188,622 filed Aug. 11, 2008. This application is also related to U.S. Utility patent application Ser. No. 12/406,531 filed Mar. 18, 2009 and entitled "VEHICLE, SYSTEM AND METHOD FOR HANDLING CARGO CONTAINERS".

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING

N/A

FIELD OF THE INVENTION

The present invention relates, in general, to cargo transport and, more particularly, this invention relates to a system, network and method for intermodal cargo transporting by utilizing end loading railways cars and improved loading/unloading cargo terminals.

BACKGROUND OF THE INVENTION

As is generally well known, operation of present intermodal transport networks is disadvantaged by a variety of factors including poor intermodal exchange procedures, excessive transloading of cargo and excessive time delays in rail yard operations. Subsequently, a substantial amount of cargo is presently transported by over-the-road trucks. However, the trucking industry has been struggling for years because of the relentless problems of higher labor, equipment and fuel costs. Trucking company linehaul expenses, when compared to the efficiencies of rail linehaul operation, are excessive and becoming worse by the day. Furthermore, there is a lack of coordinated freight way communications resulting in excessively long truck haul ways performance and inefficient line haul movements.

The difficulties are particularly felt by the automotive manufacturers, as vast majority of vehicles are generally loaded and unloaded more than once prior to reaching their final destination.

Therefore, there is a need for an improved system, network and method for intermodal cargo transporting.

SUMMARY OF THE INVENTION

According to one aspect, the invention provides a system for transporting cargo. The system includes a cargo terminal having a pair of longitudinal sides, at least one of the pair of longitudinal sides disposed adjacent to and spaced a predetermined distance from a railway track. The system also includes means for positioning longitudinal sides of at least one railcar at a predetermined acute angle relative to the at least one of the pair of longitudinal sides of the cargo terminal and positioning one end of such at least one railcar in close proximity thereto so as to enable loading or unloading such cargo through such one end of such at least one railcar.

According to another aspect, the invention provides a system for transporting cargo that includes at least one railcar having a pair of longitudinal sides and a pair of end doors. A cargo terminal is also provided and has at least one longitudinal side disposed adjacent to and spaced a predetermined distance from a railway track. There is a predetermined plurality of docks disposed within the at least one longitudinal side of the cargo terminal. Finally, a railway switch assembly positiones the longitudinal sides of the at least one railcar at a predetermined angle relative to the at least one of the pair of longitudinal sides of the cargo terminal and positioning one end of the at least one railcar in close proximity thereto and in alignment with one of the predetermined plurality of docks so as to enable loading or unloading such cargo through the one end of the at least one railcar.

According to yet another aspect, the invention provides an intermodal network for transporting cargo. The network includes a first cargo terminal having a pair of longitudinal sides, at least one of the pair of longitudinal sides disposed adjacent to and spaced a predetermined distance from a railway track. A second cargo terminal is also provided and has a pair of longitudinal sides, at least one of the pair of longitudinal sides disposed adjacent to and spaced a predetermined distance from the railway track. There is means for positioning longitudinal sides of at least one railcar at a predetermined acute angle relative to the at least one of the pair of longitudinal sides of the each of the first and second cargo terminals and positioning one end of such at least one railcar in close proximity thereto so as to enable loading or unloading such cargo through such one end of such at least one railcar.

According to a further aspect, the invention provides a method for intermodal cargo transporting. The method includes the step of providing at least a pair of elongated cargo terminal. Then, connecting, by a railway track, the at least pair of cargo terminals. Next, providing at least one of each at least one end loading railcar and at least one trailer. Positioning the at least one end loading railcar at a first predetermined acute angle relative to one longitudinal side of one of the at least pair of cargo terminals. Next, positioning the one of the at least one end loading railcar and the at least one trailer at a second predetermined acute angle relative to an opposed longitudinal side of the cargo terminal. Then, transloading cargo between the longitudinal sides of the one of the at least pair of cargo terminals. Transporting the cargo, by way of the at least one railcar, to an opposed one of the at least pair of cargo terminals. Finally, transloading cargo between the longitudinal sides of the opposed one of the at least pair of cargo terminals.

According to yet another aspect, the invention provides a method for transporting automotive vehicles. The method includes the step of providing at least one trailer capable of carrying a predetermined plurality of the automotive vehicles in a nested arrangement. Next, providing at least one end loading autorack railcar sized to receive at least one trailer therewithin. Then, positioning vehicle terminal in close proximity to a vehicle assembly line. Docking the at least one end loading autorack railcar at the vehicle terminal. Then, loading assembled vehicles directly onto the at least one trailer. Next, loading the at least one trailer into the at least one end loading autorack railcar docked at the vehicle terminal. Transporting, by rail, the at least one end loading autorack railcar to another vehicle terminal disposed in a preselected location. Next, unloading the at least one trailer. Then, connecting the at least one unloaded trailer to a truck cab. Finally, transporting, by way of the truck cab, the at least one unloaded trailer to a delivery destination.

OBJECTS OF THE INVENTION

It is, therefore, one of the primary objects of the present invention to provide a system for intermodal transporting cargo.

Another object of the present invention is to provide an intermodal cargo transporting system that employs end loaded box cars and cargo terminals capable of receiving such end loaded box cars.

Yet another object of the present invention is to provide an intermodal cargo transporting system that improves efficiency of cargo loading and unloading.

A further object of the present invention is to provide an intermodal cargo transporting system that improves efficiency of cargo transfer between rail and trucking operations.

Yet a further object of the present invention is to provide an intermodal cargo transporting system that reduces operating costs.

An additional object of the present invention is to provide an intermodal network for transporting cargo.

Another object of the present invention is to provide an intermodal cargo transporting network that employs the above described intermodal cargo transporting system.

Yet another object of the present invention is to provide an intermodal cargo transporting network that reduces costs of transporting automotive vehicles.

A further object of the present invention is to provide a method of transporting cargo utilizing the above described intermodal cargo transporting system and system.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
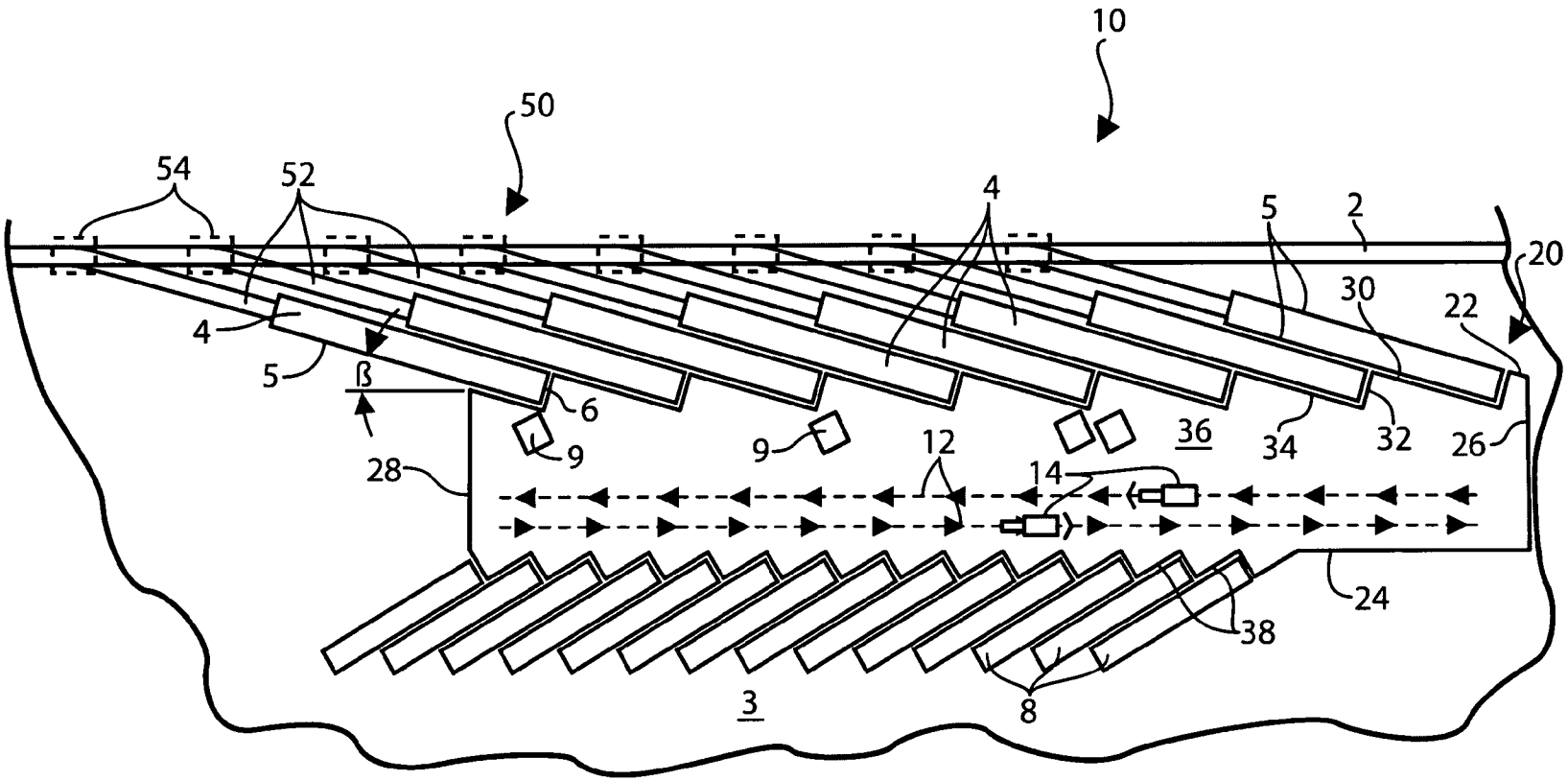
FIG. 1 is a schematic diagram of a system of the present invention for transporting cargo.

Prior to proceeding to the more detailed description of the present invention, it should be noted that, for the sake of clarity and understanding, identical components which have identical functions have been identified with identical reference numerals throughout the several views illustrated in the drawing figures.

It is to be understood that the definition of a linehaul applies to movement of cargo between two destinations (for example such as cities or ports), especially those more than about 1,500 kilometers or about 1,000 miles apart.

Reference is now made, to FIGS. 1-7, wherein there is shown a system, generally designated 10, for transporting cargo. A first essential element of the system 10 is a cargo terminal, generally designated as 20. The cargo terminal 20 has an elongated shape defined by a pair of opposed longitudinal sides 22, 24 and a pair of opposed ends 26, 28. The longitudinal sides 22, 24 are significantly greater in length than the opposed ends 26, 28. At least one of the pair of longitudinal sides 22, 24, referenced with numeral 22 in FIG. 1, is disposed adjacent to and spaced a predetermined distance from a railway track 2. Although only one railway track 2 is shown in various Figures, the present invention is operable with a predetermined plurality of spaced apart railway tracks 2.

Another essential element of the system 10 is means, generally designated as 50, for docking such at least one railcar 4 in a predetermined configuration to the side 22 of the cargo terminal 20. More particularly, such means 50 provide for positioning longitudinal sides 5 of at least one railcar 4 at a predetermined angle β, preferably acute, relative to the longitudinal side 22 of the cargo terminal 20 and positioning one end 6 of such at least one railcar 4 in close proximity thereto so as to enable loading or unloading such cargo through such one end 6 of such at least one railcar 4. It would be appreciated that such cargo terminal 20 is capable of handling a predetermined plurality of such railcars 4.

Figure 3:
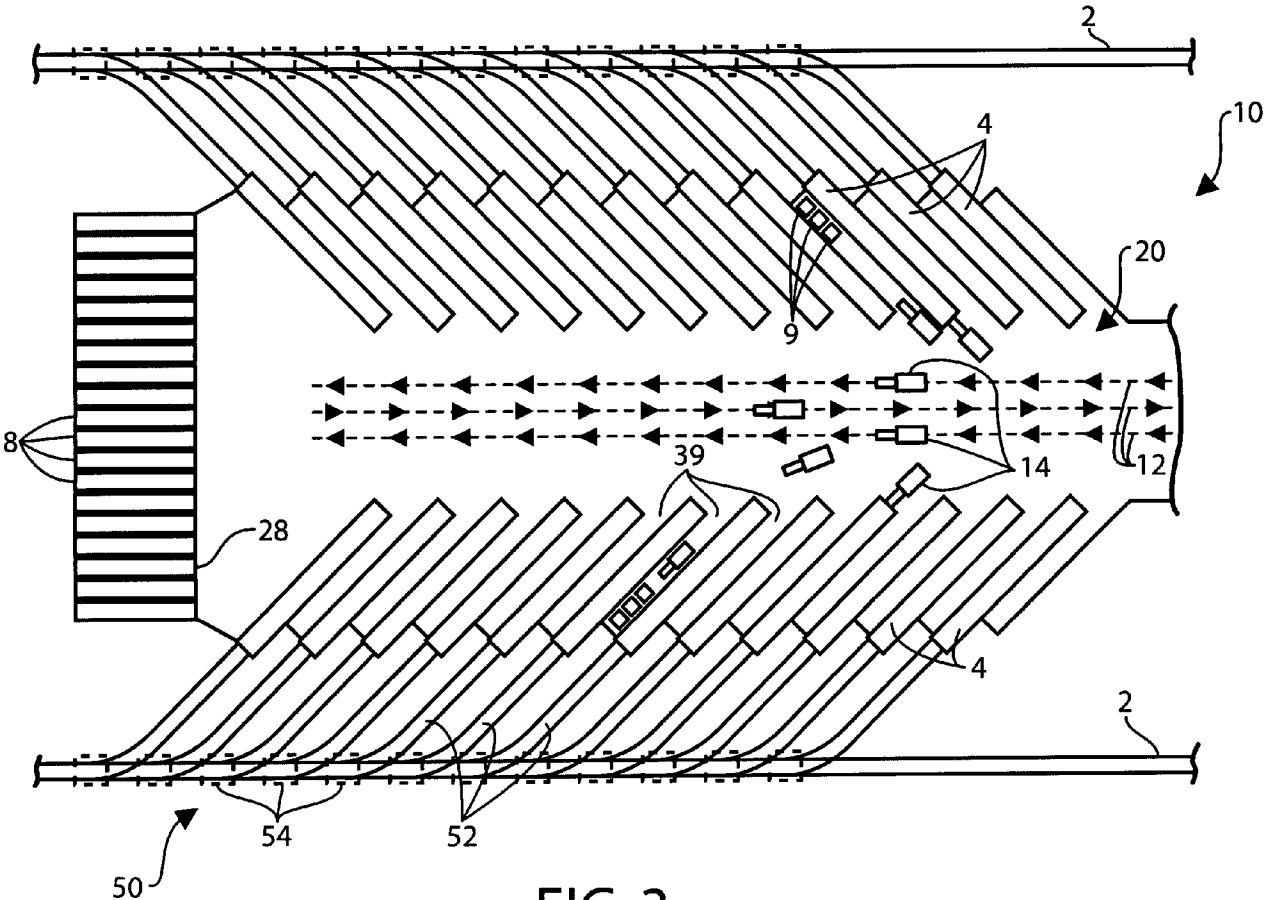
FIG. 3 is a schematic diagram of the system of FIG. 1, particularly illustrating handling of railcars at both sides of the cargo terminal.

In accordance with one embodiment of the invention, best shown in FIGS. 1 and 3, such means 50 includes a predetermined plurality of partially curvilinear railway track branches 52, each having one end thereof positioned in close proximity to the side 22 of the cargo terminal 20 and having an opposed end thereof connected to the railway track 2 with a conventional railway track switch 54.

Figure 2A:
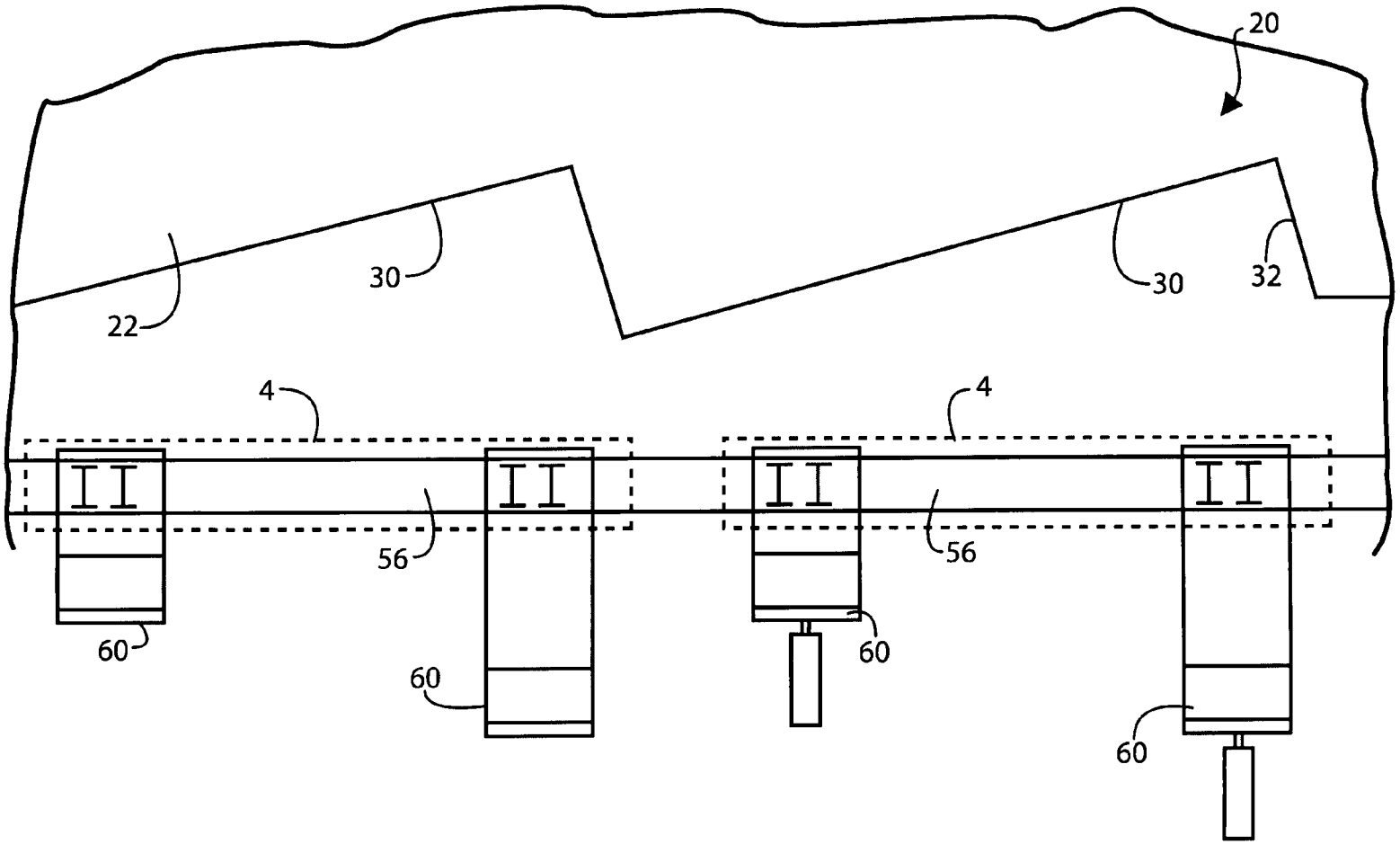
FIGS. 2*a*-2*c* are schematic diagrams of the system of FIG. 1, particularly illustrating railcar positioning means constructed in accordance with one embodiment of the invention.
Figure 2B:
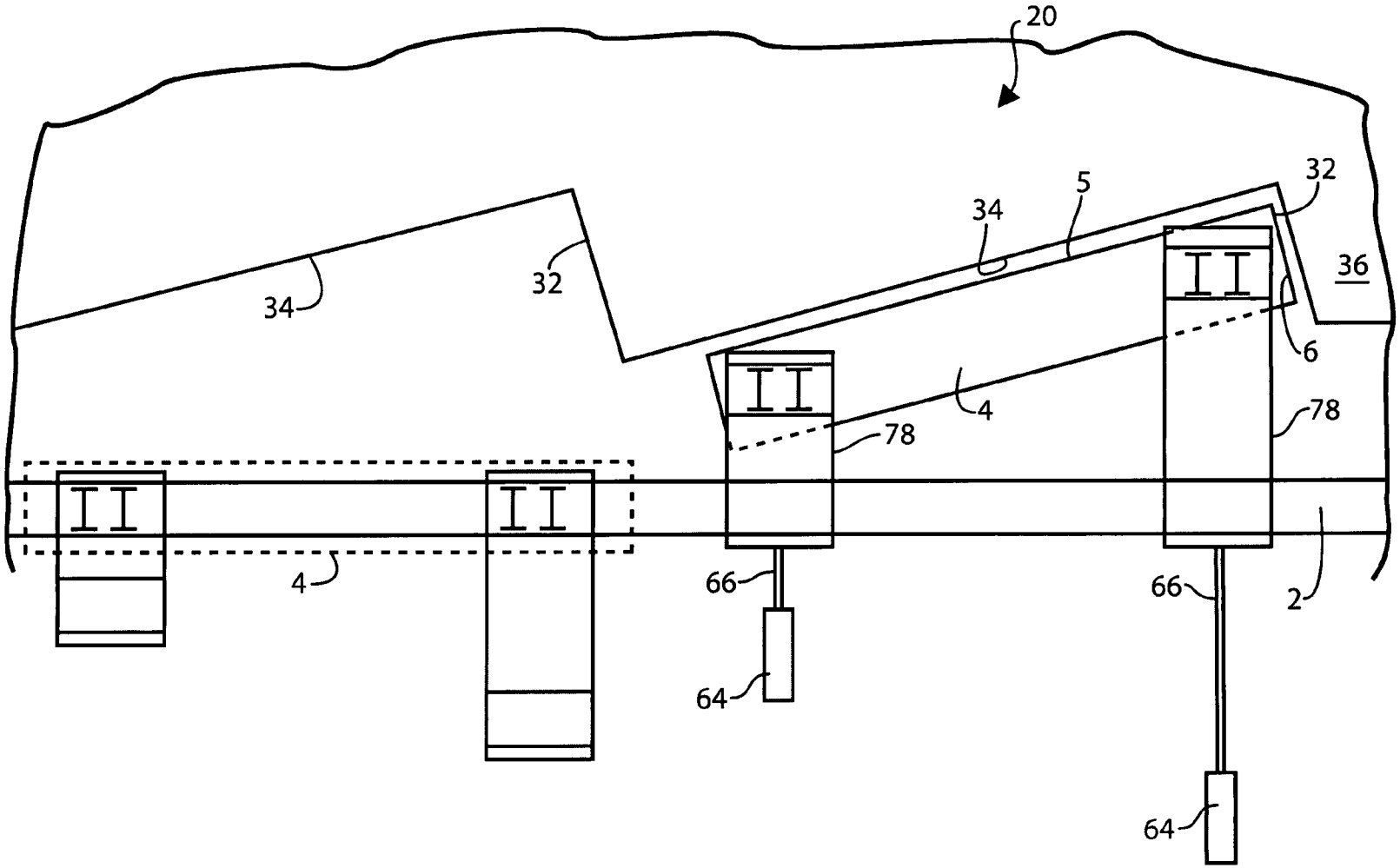
Figure 2C:
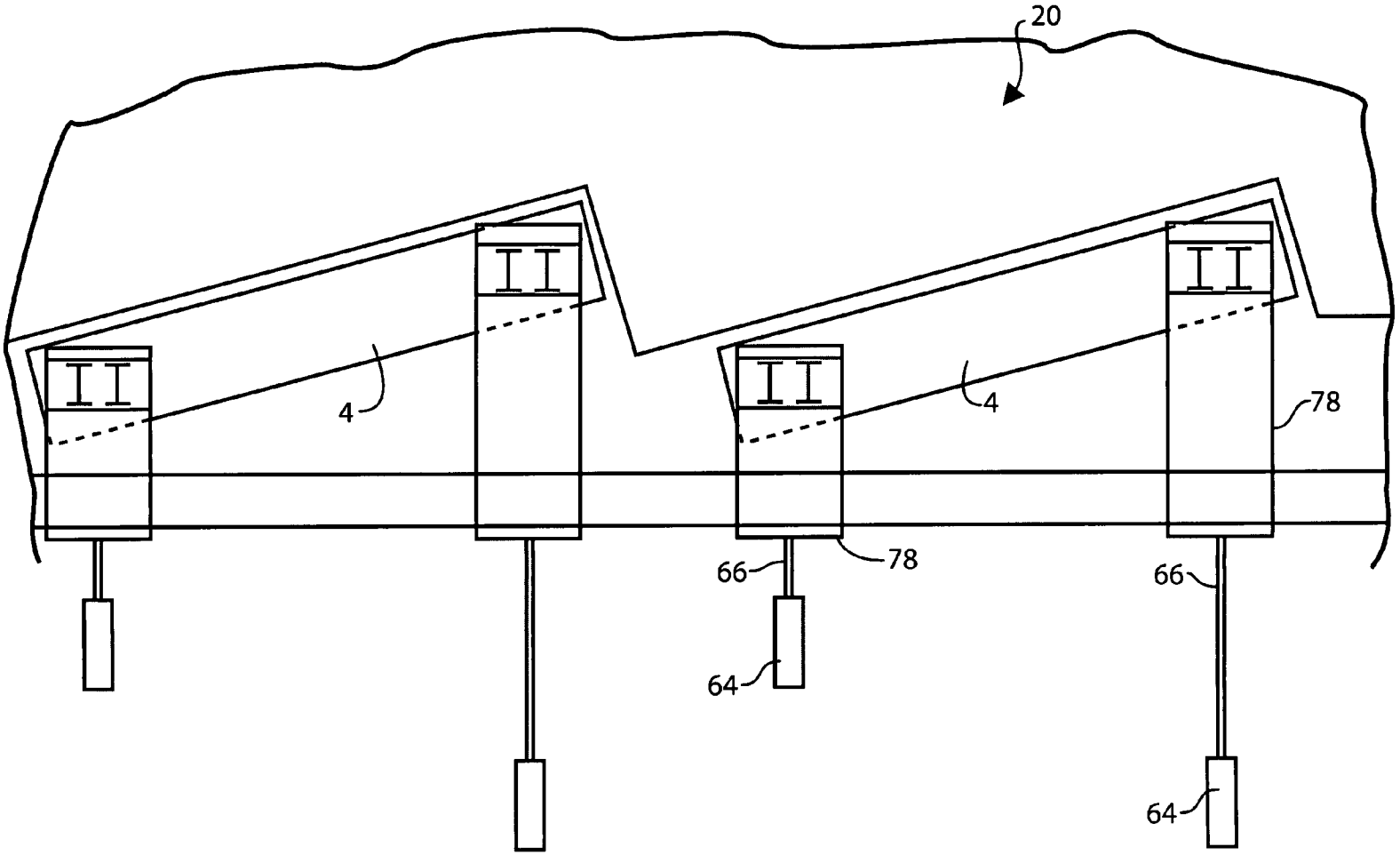

In accordance with another embodiment of the invention, best shown in FIGS. 2*a*-2*c*, such means 50 includes a predetermined plurality of straight track portions 56 and a predetermined plurality of track moving assemblies 60. Each assembly 60 includes a powered apparatus, for example such as a hydraulic cylinder 64, but that could be any one of well known types capable of generating linear motion. The hydraulic cylinder 64 has a movable portion 66 secured to a base member 78. The base member 78 has such track portion 56 secured thereon for movement, by way of the hydraulic cylinder 64, between a first position wherein the track portion 56 is aligned with the track 2, as best shown in FIGS. 2*a*-2*b*, and a second position wherein the track portion 62 is disposed at such predetermined angle β relative to the longitudinal side 22 of the cargo terminal 20, as best shown in FIGS. 2*b*-2*c*.

In further reference to FIG. 1, the longitudinal side 22 of the cargo terminal 20 is accordingly adapted with a "saw-tooth" shape by way of triangular notches 30 having one leg 32 thereof disposed generally planar with the end 6 of the at least one railcar 4. Such one leg 32 is then adapted with a dock 36. The other leg 34 of the notch 30 is then disposed generally parallel with the longitudinal sides 5 of the at least one railcar 4.

Figure 4:
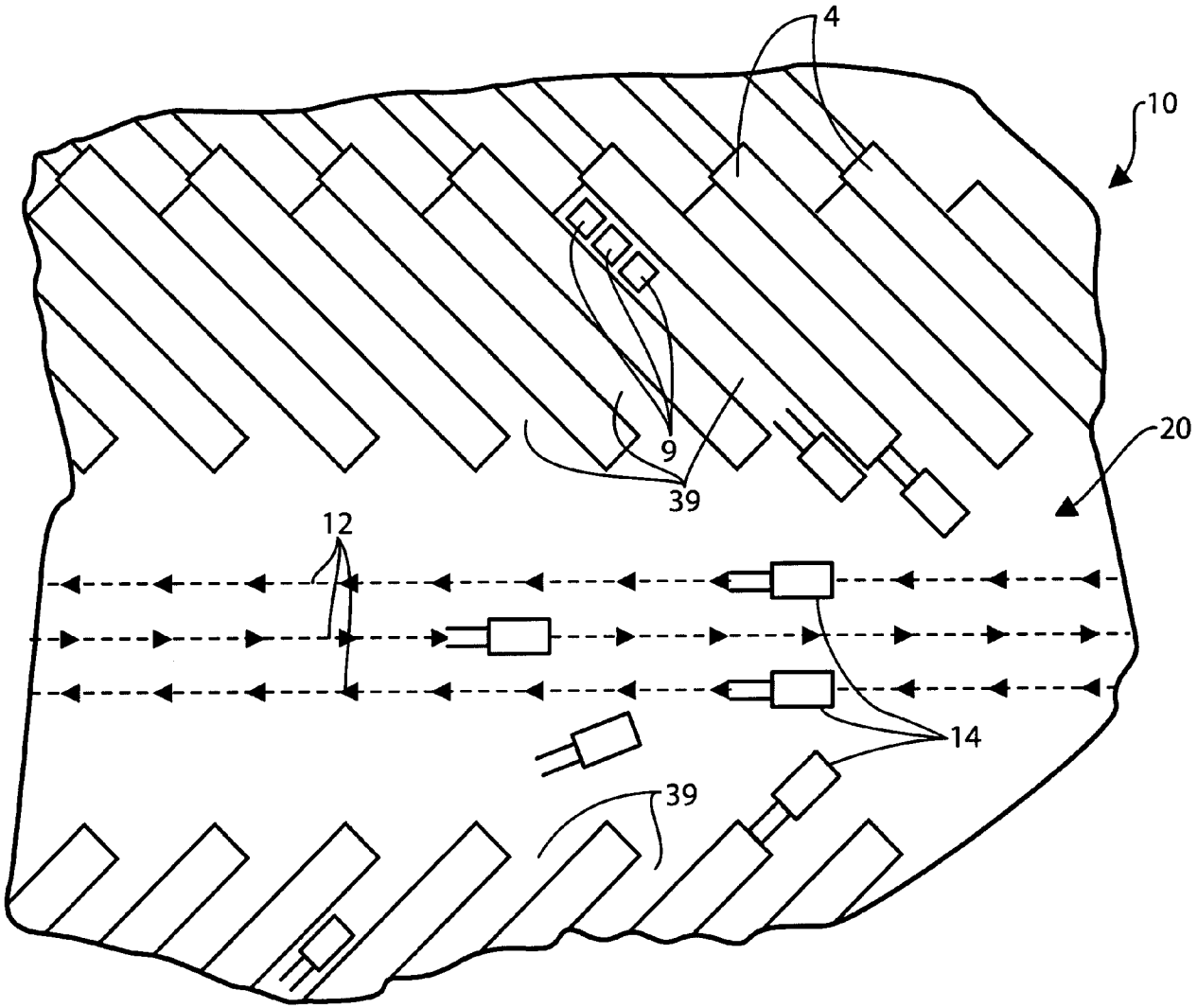
FIG. 4 is a partial enlarged view of the system of FIG. 3.

The other longitudinal side 24 of the cargo terminal 20 is configured to accept either additional railcars 4 by way of a second railway track 2 and a second plurality of railcar positioning means 50, as best illustrated in FIGS. 3-4, or predetermined plurality of conventional over-the-road end loading trailers 8 which can be also a conventional end loading van or truck, as best shown in FIG. 1. Preferably, the longitudinal side 24 is also configured with in a "saw-tooth" shape by way of triangular notches 38.

The system 10 is preferably configured for intermodal use, i.e. transloading cargo between railcars 4 and trailers 8. In this configuration, the cargo terminal 20, operating in a terminus mode, is positioned between the railway track 2 and a drive-on surface 3 and each notch 38 is generally smaller than the notch 30. In this configuration the cargo terminal 20 is designed to provide rapid freight interchanges between trucking and railroad operations.

End loading railcars 4 can crossdock with trailers or containers 8 within a much smaller terminal floor footprint than conventional side loading railcars. The unique floor plan of the cargo terminal 20 and lot design enhances terminal operations by creating an efficient traffic flow of all equipment. Docks 36 are cut at generally acute angles into the terminal's longitudinal sides 22, 24, significantly reducing the width of each the required real estate and cargo terminal 20 as well as enhancing traffic flow and safety. A long and narrow design of the cargo terminal 20 compliments the linear configuration of railroad rights-of-way, thus improving opportunities for real estate selection as the railroad properties tend to be linear and narrow.

The angular railcar docking configuration enhances efficiency of the transloading process within the cargo terminal 20. Specific forklift traffic patterns 12 are established so as to minimize turning angles of the forklifts 14 and improve operator visibility by substantially minimizing "blind spots" present in conventional terminals (backing out of containers, freight staged in middle of the terminal floor and around dock doors that restrict views). Troublesome intersecting forklift cross-traffic patterns of the conventional cargo terminals are generally eliminated or at least significantly reduced, resulting in efficient and simple traffic flow pattern that keeps turning angles down to less than 45 degrees elevating the level of safety and significantly increasing terminal throughput velocity. Furthermore, conventional crossdock patterns of "stop, look and go" traffic and frequency of right-of-way decisions with stop and go movements are substantially reduced thus resulting in improved operational safety. Operational traffic efficiencies within the cargo terminal 20 promulgate significant increases in cargo transfer speed at lower cost.

Figure 5:
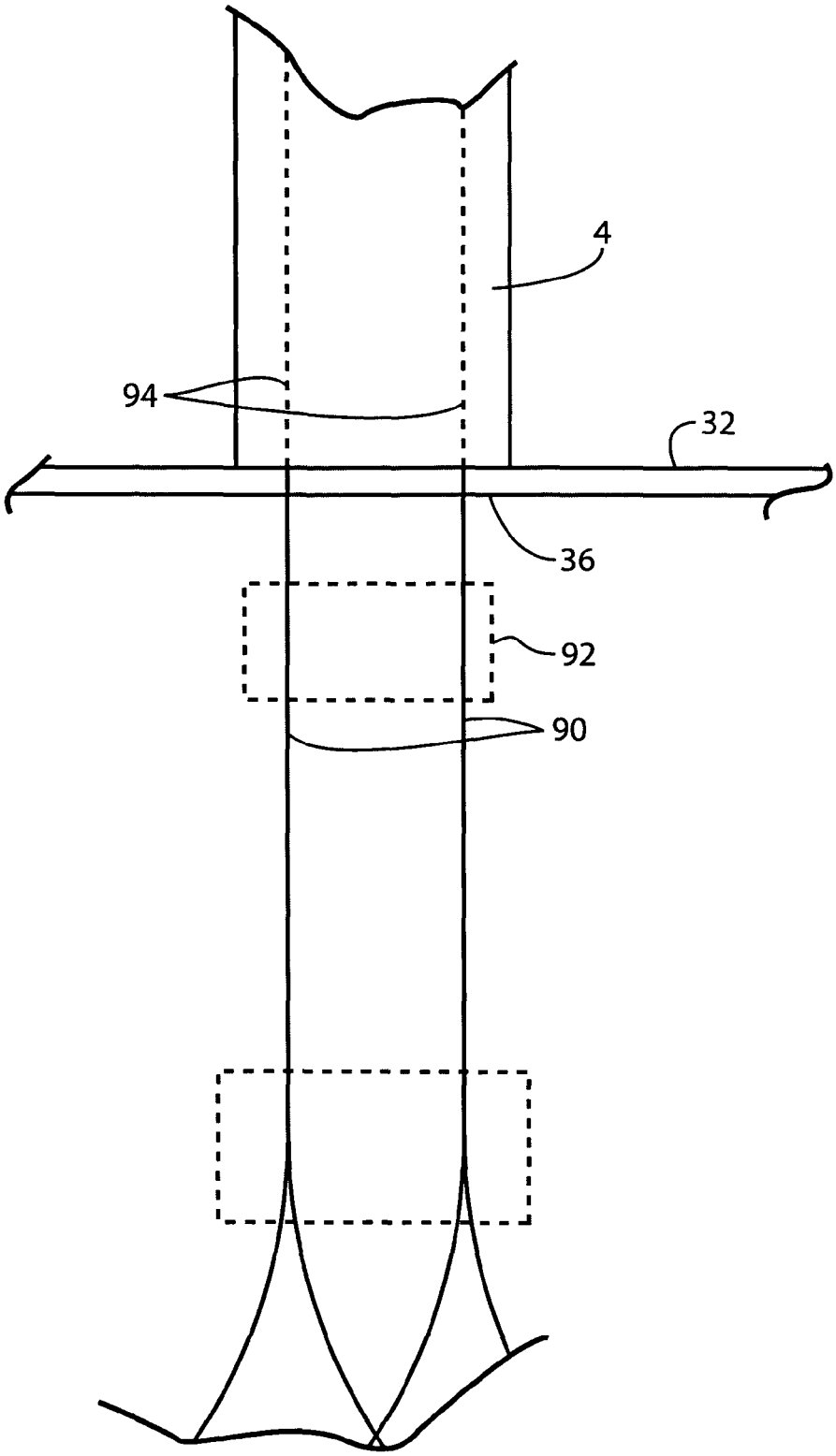
FIG. 5 is a schematic diagram of the system of FIG. 1, particularly illustrating automatic vehicle guiding arrangement for loading and unloading cargo.

It is also within the scope of the present invention to employ automated guided vehicles (AGV) 92 traveling on tracks 92 disposed within the floor of the cargo terminal 20 and complimenting tracks 94 provided within the railcar 4, as best shown in FIG. 5.

Furthermore, employing AGVs 92 for movements in and out of the NLS boxcar 4 allows the cargo handling process to be completed in a shorter period of time, at times measured in only a few minutes. There would no longer be the need for forklifts 14 to enter the NLS boxcar 4, as a single AGV 92 could be used to move coupled cargo in or out of the railcar 4 in a single effort. This would make volume throughput velocity of the cargo terminal 20 far faster than anything available conventionally and allow for an extremely quick railcar back-haul turnaround. In addition, railcar and cargo damages caused by forklifts 14 would be significantly eliminated.

Thus, one of the primary advantages of the cargo terminal 20 of the present invention is increased capacity in terms of the access capacity relative to the length of the sides 22, 24.

For every conventional side loaded railcar docked at the side of the cargo terminal 20, the present invention generally allows docking of between six (6) and ten (10) end loaded railcars 4.

The system 10 may also be configured for unimodal cargo transloading, i.e. transloading cargo between railcars 4 in a hub and spoke rail crossdocking operation. In this configuration, as best shown in FIGS. 3-4, the cargo terminal 20 is positioned between a pair of railway tracks 2.

The cargo exchange activity is generally reduced to just two simple steps. The first step is a removal of cargo from their inbound railcars 4 and moving it to either predetermined cargo staging areas that are preferably disposed adjacent to the designated outbound railcars 4 or directly to the outbound railcars 4. The second step is a simple loading the cargo into their designated outbound railcars 4.

The flow traffic pattern of the forklifts 14 are similar to those of the cargo terminal 20 of FIG. 1, thus applying the same practices of efficiency, speed and safety.

It is also within the scope of the present invention to adapt at least one end of the cargo terminal 20 for loading/unloading cargo onto/from railcar 4 or truck trailer 8, as best shown in FIG. 3. This is particularly advantageous for accommodating local and intra-regional cargo.

The generally acute angle β, at which each railcar 4 is positioned, minimizes the overall width of the cargo terminal 20, complimenting the linear and narrow terminal design by further reducing the width required for railcar and trailer lot activities, docking and parking. The angle β is generally determined based on the available land width and/or number of railcars 4 to be docked simultaneously at a cargo terminal 20. It would be appreciated that in crease in the value of the angle β enables the cargo terminal 20 to accommodate larger number of railcars 4.

Although, the cargo can be staged adjacent the dock 36, as best shown in FIG. 1, the present invention contemplates that adjacent railcars 4 may be spaced apart a predetermined distance so as to allow staging of such cargo between such pair of railcars 4 in the generally rectangular recesses 39 and generally along the length thereof, as best shown in FIGS. 3-4.

The system 10 and, more particularly, cargo terminals 20 are designed for the rapid modal interchange of freight cargo in preparation for long distance linehaul movement across a continent, for example such as North America, and for preparation for local deliveries.

It is also contemplated by the present invention to locate at least one cargo terminal 20, particularly of FIGS. 3-4, in at least one strategic location within such linehaul path and mediate ends thereof so that such at least one cargo terminal 20 will function to sort cargo for inter-regional linehaul movements.

Figure 6:
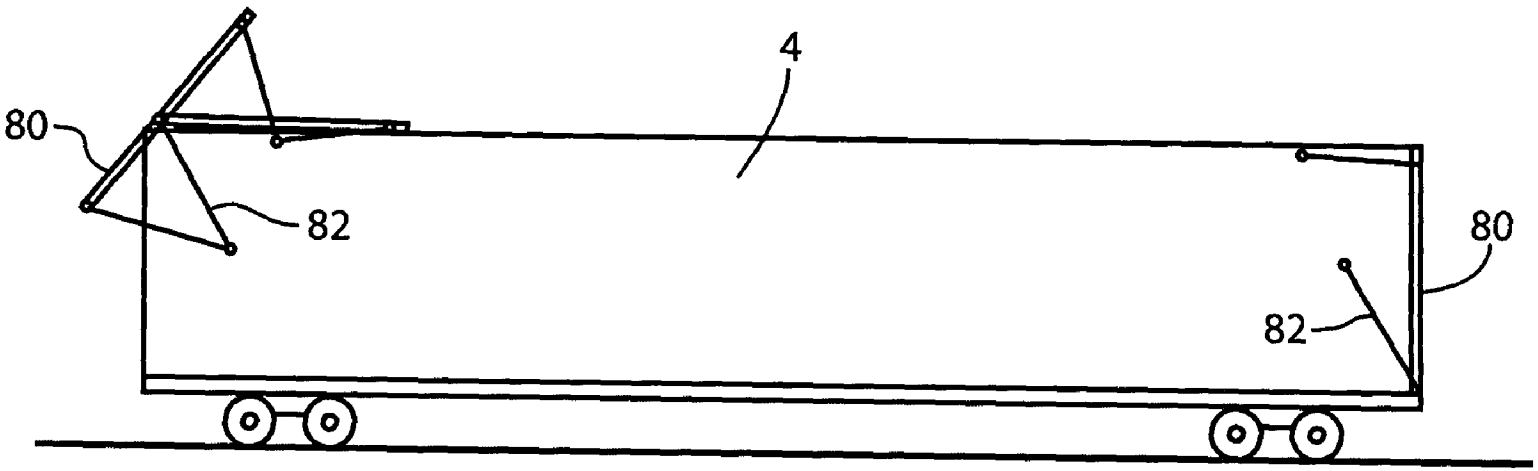
FIG. 6 is side elevation view of an end loading box car constructed in accordance with another embodiment of the invention and employed within the system of the present invention for transporting cargo.
Figure 7:
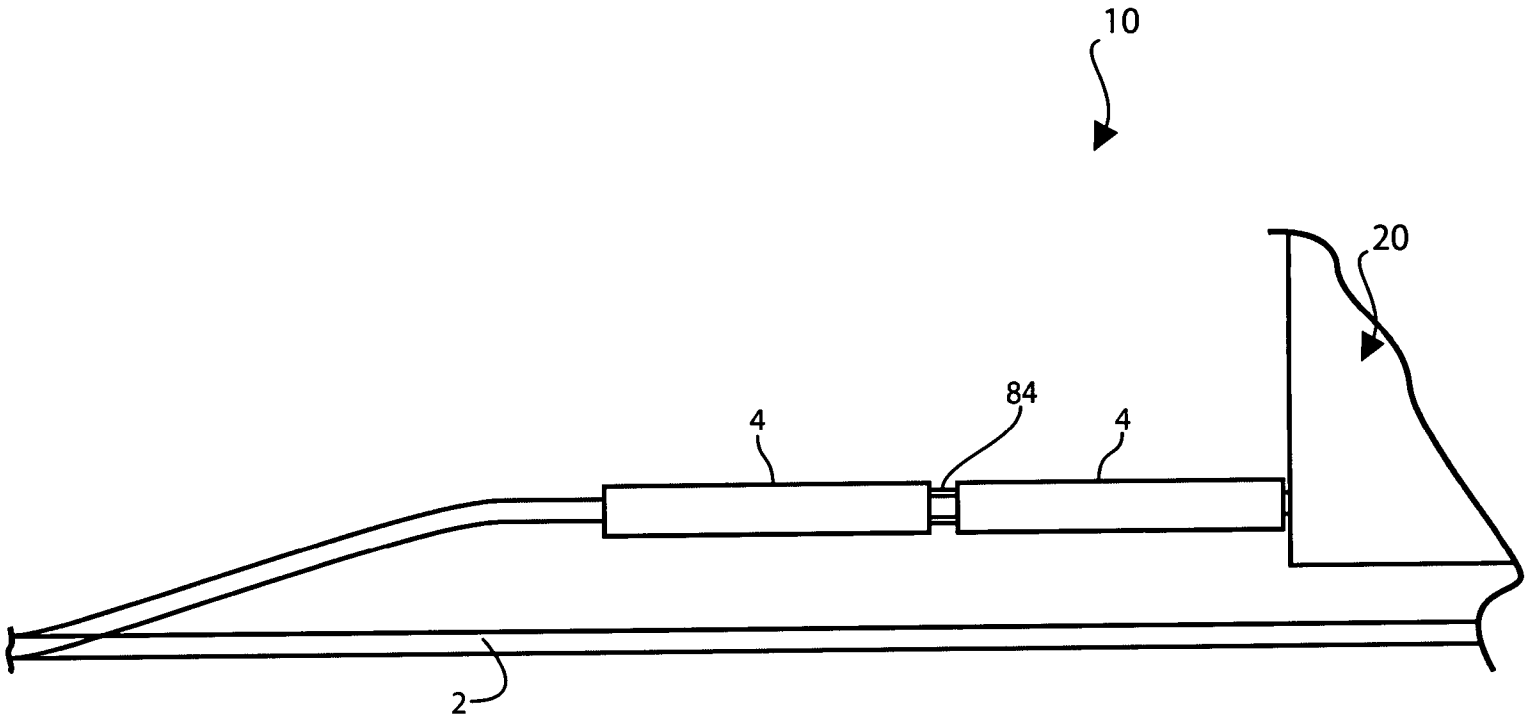
FIG. 7 is a schematic diagram of the system of FIG. 1, particularly illustrating a bridging member between a pair of railcars.

The present invention takes advantage of employing box-type railcars 4, best shown in FIG. 6, with weatherproofed doors 80 mounted at each end thereof and movable by way of either manually or power operated apparatus 82 for enabling loading/unloading such railcar 4 from either end. The cargo can be handled from door openings at either end of the railcar 4, so that the load/unload working process can be accomplished without the necessity of freight handling vehicles making left and right turns as is required for center side door boxcar handling. This will allow the cargo to be moved in and out with greater ease, speed and safety. As the result, throughput of the cargo terminal 20 is also improved. Although the fully open doors 80 are shown in FIG. 6 as being positioned on top of the railcar 4, other types of door movements are suitable for use within the present invention.

It is further presently preferred for the railcars 4 to be wider than conventional box-type railcars. Preferably, the width of such railcar 4 is approximately ten (10') feet that can be legally accommodated on existing rail tracks. The interior height of such railcar 4 is approximately fifteen (15) feet and a loading floor length of approximately eighty-six (86) feet. Approximate cargo volume capacity is about twelve thousand nine hundred (12,900) cubic feet and approximate cargo weight capacity is about one hundred and eight four thousands (184,000) pounds.

Since the industry studies have concluded that freight boxes (marine containers, domestic containers and highway trailers) on average cube load freight at approximately fifty (50) percent of the container's total cubic capacity, a single railcar 4, constructed in accordance with the above disclosed sizes, to carry the volume capacity of three (3) fifty-three (53) foot highway trailers or five (5) forty (40) foot equivalent units (FEU) marine containers and that the above railcar 4 utilizing at least ninety (90) percent volume load capacity could carry up to ten (10) FEUs or six (6) fifty-three (53) foot trailer loads of freight. Such railcar will be further referred to in this application as "NLS boxcar 4".

Thus, substantial cost savings can be achieved as illustrated in the following example of cargo travel from Laredo, Texas to Chicago, Ill. with return by reverse route equaling about two thousands seven hundred and four (2,704) miles, round trip. Truck rate for this route is about one dollar and seventy five cents ($1.75) per mile. Railroad rate is about six thousands three hundred dollars ($6,300). When compared by volume, the trip cost for three (3) trucks is about fourteen thousands two hundred dollars ($14,300) with the savings of about eight thousand dollars ($8,000). When compared by weight, the trip cost for five (5) trucks is about twenty three thousand six hundred dollars ($23,600) with the savings of about seventeen thousands three hundred dollars ($17,300).

When multiple NLS boxcars 4 remain in a single consist of cars, end doors 80 could be opened and connecting plates 84 could be used to bridge between the adjacent railcars so that the cargo could be handled from several NLS boxcars 4 through a single dock location. Horizontal channels (not shown), connected to the interior walls of the NLS Boxcar 4, could be used to place sliding adjustable bulkheads and cushioning devices (not shown) to secure and protect the cargo.

Figure 8:
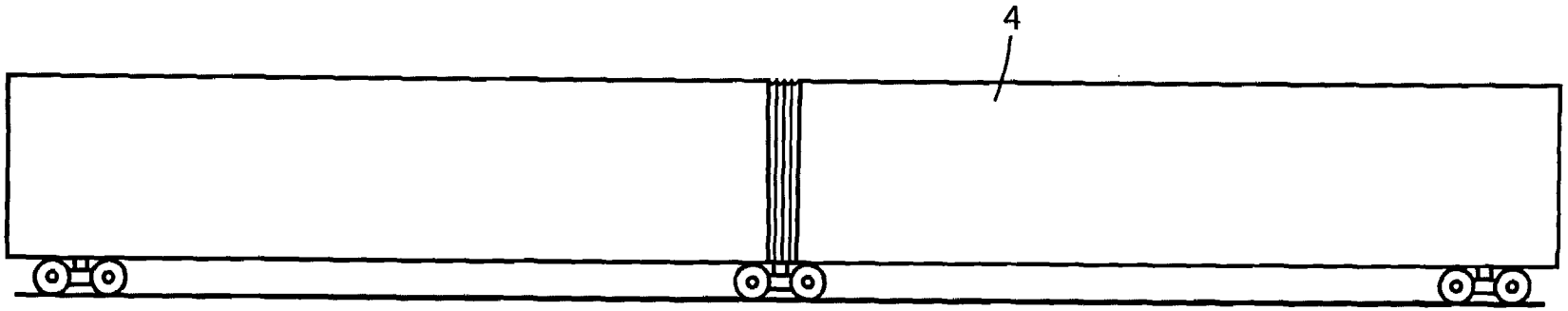
FIG. 8 is a another side elevation view an end loading box car.

NLS boxcar 4 may be also designed as an articulated unit, as best shown in FIG. 8, providing substantially greater ability for increase load capacity. The articulated railcar design may have a cargo length capacity of one hundred and forty (140) feet or more. A similar car design currently exists, such as the AutoMax autorack car, built by Greenbrier Company for finished vehicle transport.

Figure 9:
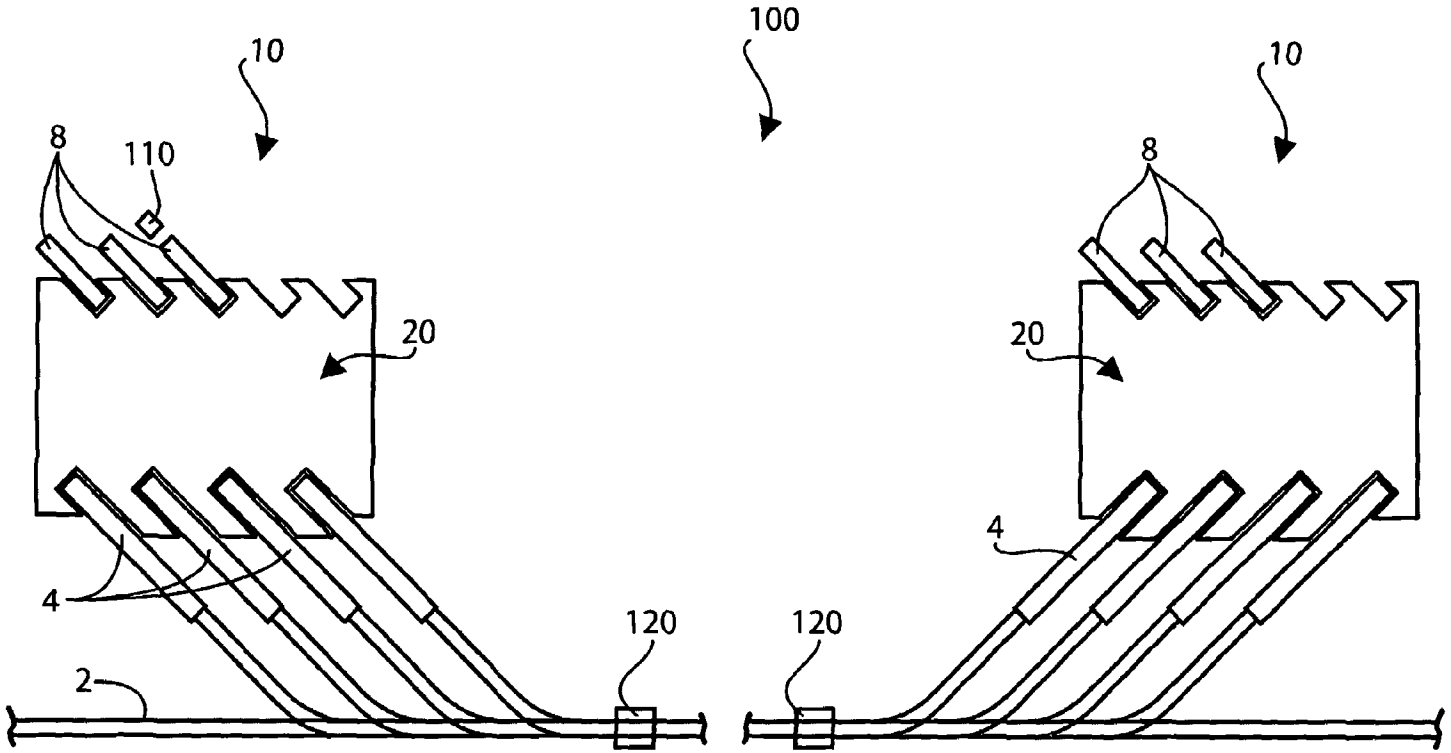
FIG. 9 is a schematic diagram of a network of the present invention for transporting cargo.

The present invention also provides a novel National Linehaul Service (NLS) Network 100, best shown in FIG. 9, promulgating cost effective long distance intermodal linehaul operation. With strategically positioned cargo terminals 20, the present invention also provides a new and very efficient hub and spoke NLS network.

One main advantage of the NLS network 100 of the present invention is in that the cargo is economically transported over long distances by way of NLS boxcars 4, rapidly transloaded, with minimum handling, at cargo terminals 20 between the NLS boxcar 4 and trailers 8 and is economically transported in "first and last mile" pick-up and delivery (P&D) services by way of trailers 8. It would be appreciated that P&D services are associated with short distances (local and some intra-regional routes) where transport by trailer 8 is most advantageous. All consignee/consignor relations will preferably remain as trucking company functions.

Another main advantage of the NLS network 100 is in increasing throughput at each cargo terminal 20. Trailer yard hustlers 110 are used to position (dock) and stage trailers 8 into designated locations within the terminal yard. Since NLS boxcars 4 dock to cargo terminal 20 similarly to trailers 8, yard hustlers 120 are also utilized to spot box-type railcars 4 with the same staging flexibility as highway trailers 8. The square footage of the transloading cargo terminals 20 will be much smaller than present-day transloading facilities due to the fact that end-loading box-type railcars 4 require much less floor space than side-loading boxcar docks which require as much as sixty (60) to eight (80) feet between access points (doors). All this translates into much greater throughput capacity and higher freight velocity when comparing NLS transloading operations to present day transloading terminal methods.

Information technology will be used at all NLS cargo terminals 20 to receive service requests, schedule, load plan, dispatch, track, transfer, arrive and bill the freight. Notification of estimated time of arrival will be communicated to the inbound trucking companies so as to allow enough time for them to dispatch driver(s) and equipment to receive their cargo immediately upon arrival, preventing transit time loss or demurrage. Warehousing and distribution center operations and practices may be conducted directly from the NLS cargo terminals 20. The US Postal Department may also benefit by this service in its long distance transport between Bulk Mail Centers.

Thus, the NLS network 100 reduces transportation costs by assembling and transporting more efficient unit loads of cargo, segmenting the intermodal transport of cargo into an efficient movement that utilizes the best operational advantages of both truck and rail, i.e capitalizing on the best productive output and costs of each mode, wherein the trucking companies perform the P&D functions and terminal management operations and the railroads perform "hook & haul" long distance linehaul operations, and performing rapid intermodal exchanges of cargo through cargo terminals 20 which are uniquely designed to facilitate transloading of large quantities of freight within a very compressed period of time and reduced space.

The present invention further takes advantage of employing unit load devices (ULD) 9 as the presently preferred mode of handling cargo to optimize throughput and transloading efficiency. ULD 9 is essentially a crate that is either fully enclosed or at least partially open. ULD 9 functions as primary handling platform for all cargo. The ULDs 9 are provided in multiple integrated sizes that combine to fit easily within standard trailers 8, FEUs and the end loading NLS boxcars 4. The NLS ULDs 9 are considerably larger than a conventional pallet and must universally fit within all types of sea and land containers and over-the-road trucks. It is presently preferred to provide the ULDs 9 in the following two size ranges: 9-10"L×7'-10"W×4'-6"H and 9'-10"'L×7'-10"W×7'-0"H. The dimensions of the ULD 9 will be predicated upon the most universal sizes for loading snugly within the width openings of ISO containers, domestic containers and trailers and also being capable, when rotated ninety (90)

degrees, to fit snugly into a NLS boxcar 4 with the above stated width of approximately ten (10) feet, interior height of approximately fifteen (15) feet and a loading floor length of approximately eighty-four (84) feet.

To increase carrying capacity of the NLS boxcar 4, the ULDs 9 are stackable upon one another so as to fill the height of the NLS boxcar 4 which has an interior height clearance of fifteen and a half (15.5) feet allowing maximum cubic volume utilization within all types of freight containers. This stacking arrangement provides the capability of fitting two (2) rows of ULDs 9 in most containers and trailers 8 and three (3) rows in the NLS boxcar 4.

ULDs 9 may be of a collapsible type to be collapsed when empty for stacking one upon another for back haul efficiency. Each ULD 9 will have owner/user ID and an individual unit ID.

In accordance with the most preferred embodiment of the invention, the ULDs 9 will be the property of the customers of the intermodal NLS network 100. They are the Truckload, Less-than-truckload, Private Carrier and other asset based transportation companies. The ULDs 9 are made available to the trucking companies to be securely loaded with freight cargo before delivering them to the outbound NLS cargo terminal 20 where they can be stacked and rapidly transloaded into the NLS boxcar 4. Each ULD 9 is completely pre-booked and scheduled prior to arrival at the outbound NLS cargo terminal 20. Each ULD 9 when delivered to the NLS cargo terminal 20 comes fully prepared to ship, loaded with cargo that is properly packed and secured. It is presently preferred that the NLS cargo terminals 20 will not handle any cargo directly; they will simply transload the ULDs 9 from one mode to the other in a cross-docking operation. Conversely, at the inbound cargo terminal 20 the transloading process is sequenced in reverse order, transloading freight cargo from the NLS boxcars 4 to trailers 8 for the final delivery to the customers. Each ULD 9 must have a "receiving" trucking company at the inbound NLS cargo terminal 20 location that will be responsible for providing a truck and driver for the timely transloading of the ULD 9.

The ULD 9 allows multiple shippers to "share" shipments within a single ISO container, domestic container, trailer, and boxcar.

The shipper can "pre-break" multiple customer shipments at their location by sorting the cargo into smaller self-contained units of ULDs 9. Then ship the "first mile" by trailer 8 to the NLS cargo terminal 20 for the linehaul move. After which, the "last mile" can be shipped, also by trailer 8, from the inbound NLS cargo terminal 20 by to all customer locations.

The ULD 9 provides the shipper with a platform to properly load and secure the cargo, preventing damage and pilferage in transit. NO "crush" and no pallets.

The ratio of freight consolidation afforded by the ULD 9 with footprint of 9'-10"×7'-8" when compared to a conventional pallet with foot print of about 4'-0"×3'-4" is about 6 to 1. This translates into approximately 600% reduction in cargo handling and processing in a NLS cargo terminal 20 verses conventional cargo terminals handling side loading railcars and decrease in labor costs due to increase in crossdock transfer rate.

The method of importing cargo from overseas locations, for example such as from China to United States (US), by utilizing intermodal NLS network 100 of the present invention is advantageous when compared to the existing cargo importing method. Presently, FEU containers transported by marine vessel are associated with a floor loaded cargo with low cube density and sometimes have low weight density as well. Cargo is floor loaded into the FEU container at the manufacturing facility. Then, the FEU container is transported by truck or train to the marine terminal for loading onto a marine vessel. Upon arrival at a US port, the FEU container is transported to an inland port via truck or rail. When transported by truck, the FEU container is loaded on a chassis and driven to a near port terminal. When transported by rail, the FEU container is usually placed in a double stacked arrangement onto a rail car, moved to an inland rail yard, off-loaded onto a chassis and driven to a cargo transloading terminal. Next, at the transloading terminal, the cargo is unloaded, palletized and transloaded into either fifty-three (53) foot long domestic containers/chassis or highway trailers 8. However, since the palletized cargo cannot be stacked and the height of the pallet generally smaller than the available height of the containers, the volume density is low.

When the cargo is transloaded into the trailer 8, it is transported by truck to a final destination. When the cargo is transloaded into the domestic container, it is transported to a rail intermodal yard and placed in a double stacked arrangement onto a rail car and railed across country to another intermodal yard where it is unloaded and placed onto a chassis and then transported by truck to its destination.

Utilizing the intermodal NLS network 100 of the present invention, the cargo is first loaded into ULD 9, maximizing both the volume and weight densities, at the manufacturing facility. Then, then the ULDs 9 are loaded into FEU containers. One option is to load ULDs 9 for different destinations, which can then bypass warehousing activity in the US. Another option is to share FEU container by multiple manufacturers supplying a single customer in the US. This is accomplished by gathering each ULD 9 at a collection point where they can all be loaded into a single FEU container for shipment to the US customer. Next, FEU container is shipped to the marine port via truck or rail and loaded onto a marine vessel. Upon arrival at a US port, the FEU container is either moved by truck/chassis to an outbound NLS cargo terminal 20 located on the marine port grounds or is transported by truck or rail to a remote outbound NLS cargo terminal 20. In either case, the ULDs 9 are directly transloaded onto the NLS boxcars 4. At a minimum, the freight volume equivalent to five (5) FEU containers can be loaded into one NLS boxcar 4. Then, the NLS boxcars 4 are linehauled by rail across country to the inbound NLS cargo terminal 20. Finally, the ULDs 9 are transloaded into trucks for transport to a particular customer.

A customer of cargo owning multiple distribution centers, manufacturing or retail operations will benefit from designating at least one ULD 9 for a specific location, loading all ULDs 9 into FEU for marine shipments and transloading ULD 9 at the cargo terminals 20 for transport to a specific location, thus eliminating the need for intermediate warehousing operations.

The intermodal NLS network 100 of the present invention is also advantageous in transporting cargo domestically when compared with a conventional method of transporting containers by a well type railcar in the doublestacked arrangement. In the conventional method, the cargo is generally loaded into fifty-three (53) foot long containers/chassis. The containers are then transported to an outbound intermodal yard, where they are either placed into storage awaiting loading onto a well type railcar in the doublestacked arrangement, or they are loaded immediately onto the railcar. The containers are then transported by rail to the inbound intermodal yard. At the inbound intermodal yard, the containers are off-loaded onto chassis and transported by trucks to their final destinations.

With the intermodal NLS network 100 of the present invention, the cargo is loaded into ULD 9. The ULD 9 is then loaded into over-the-road trailers and is transported to the outbound NLS cargo terminal 20. At the NLS cargo terminal 20, the ULDs 9 are transloaded into NLS boxcars 4. The NLS boxcars 4 are linehauled by rail to the inbound NLS cargo terminal 20. At the inbound NLS cargo terminal 20, the ULDs 9 are then transloaded into trailers 8 and transported by truck to their final destination.

It can be concluded from the above that NLS Network 100 reduces transportation expenses by handling much larger and more efficient unit loads of cargo and segmenting an intermodal cargo movement into a coordinated series of operations with specific segments of the cargo movements handled by the mode with the better productive output and cost efficiency for that particular service, wherein truck operations manage the P&D logistics and cargo terminals while railroads operate a dedicated "hook & haul" long distance linehaul movement between the NLS cargo terminals.

Thus the present method offers numerous cost advantages. For trucking operations, operating costs are reduced by reduction in fuel consumption and labor costs and increase in equipment life. The equipment life increases due to reduction of linehaul mileage. Trucking companies can take advantage of linehaul lane weight and cube densities that they cannot be achieves by conventional methods. The trucking industry can also reduce the heavy investments in expensive conventional container and chassis purchases when compared with the far less costly ULDs 9. Maintenance costs for ULDs are significantly lower that the cost of chassis and container maintenance. It is presently expected that operating life of the ULDs 9 will be between twenty (20) and forty (40) years far exceeding the operating life of the conventional container and chassis. Additional advantages include relived driver shortage challenge, opportunities for tax credits and grant funding for capital projects and reduction in damage claims and pilferage costs For railroads, the primary advantage of the intermodal NLS network 100 is the ability to carry significantly larger unit loads of cargo relative to doublestacked arrangement of either forty (40) foot long ISO or fifty-three (53) foot long domestic containers. Load density may be increased by at least fifty (50) percent when compared with use of the fifty-three (53) foot long domestic containers. A single NLS boxcar 4 can carry a cargo volume of between two and a half (2.5) to five (5) forty (40) foot long ISO stacked onto the well type railcar. Concluding from the above points, the intermodal NLS network 100 can sell service to its customers based on the cubic capacity of the cargo and also have the added advantage of minimizing concerns of weight capacity which is the primary restriction for trucks on weight regulated highways.

Thus, railroads can increase their market share of carrying cargo and gain political advantages by engaging in the reduction of trucks on US highways. Train consist of NLS boxcars 4 has significantly less aerodynamic drag than a train consist of doublestacked wellcars reducing fuel costs by at least ten (10) percent. The overall length of the train consist of NLS boxcars 4 is approximately fifty (50) percent less than a length of train consist of doublestacked wellcars carrying an equal quantity of cargo. Load limits for US rail operations is much higher than for over-the-road trucking mode. Since NLS boxcars 4 have a much higher payload capacity than conventional well type railcars, railcar purchase quantities can be reduced. NLS boxcars 4 can now be individually spotted or removed from the docks, similar to trailer docking activity, improving boxcar flexibility. Expansion of extremely costly rail intermodal yards can be reduced.

Finally, railroads can relinquish terminal administration and operations cost to the trucking partners and create opportunities for tax credits and grant funding for capital projects.

Intermodal NLS network 100 is also advantageous in reducing pollution and carbon footprint by replacing trucking operations with rail operations, mitigating traffic congestions, improving highway safety.

National Linehaul Service may, for example, sell its services based on freight volume (cubic feet per ULD) per transport mile hauled, along with fixed terminal handling charges per ULD at the NLS outbound, breakbulk and inbound terminals.

Figure 10:
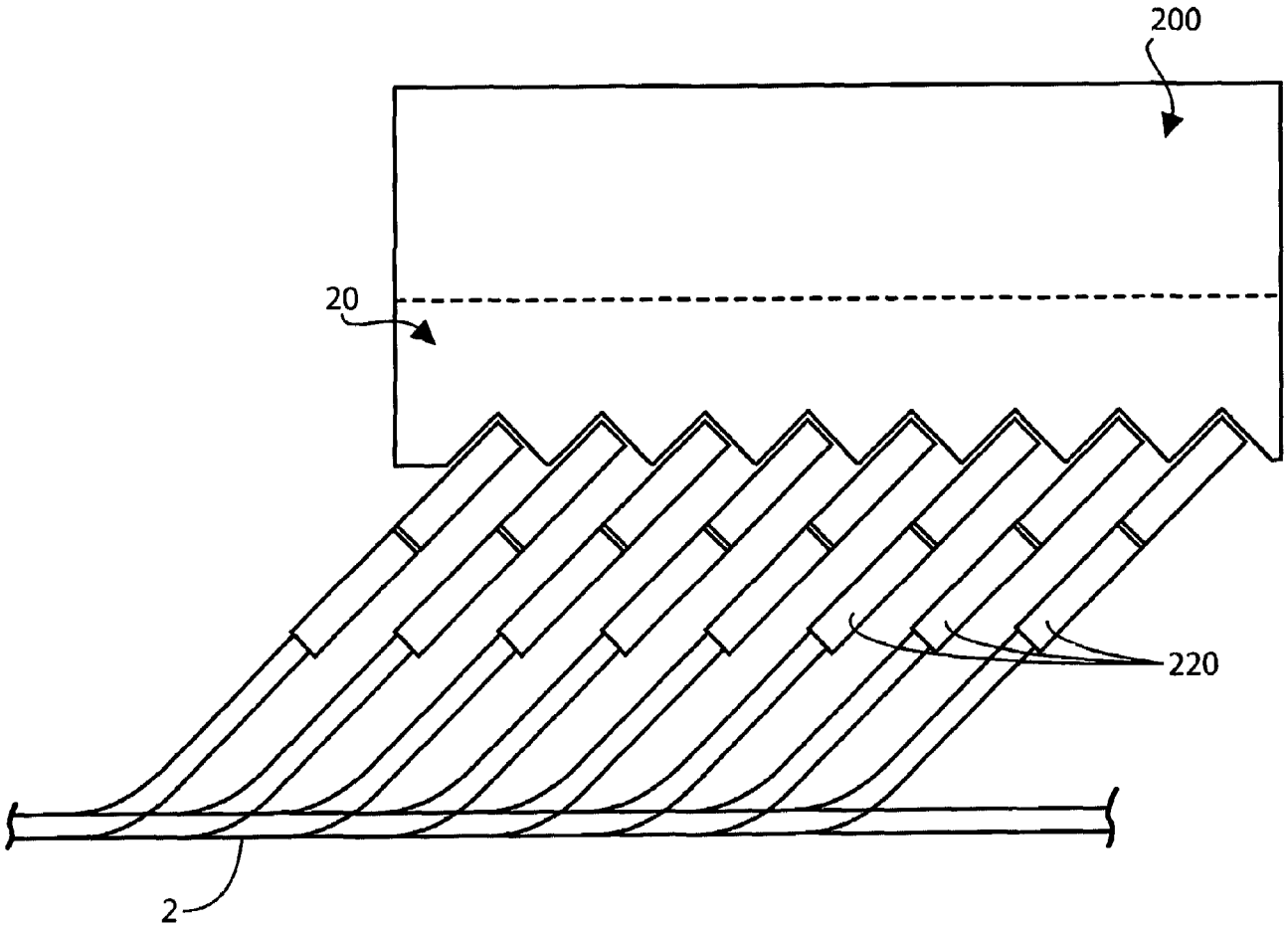
FIG. 10 is a schematic diagram of a system of the present invention for transporting automotive vehicles.
Figure 11:
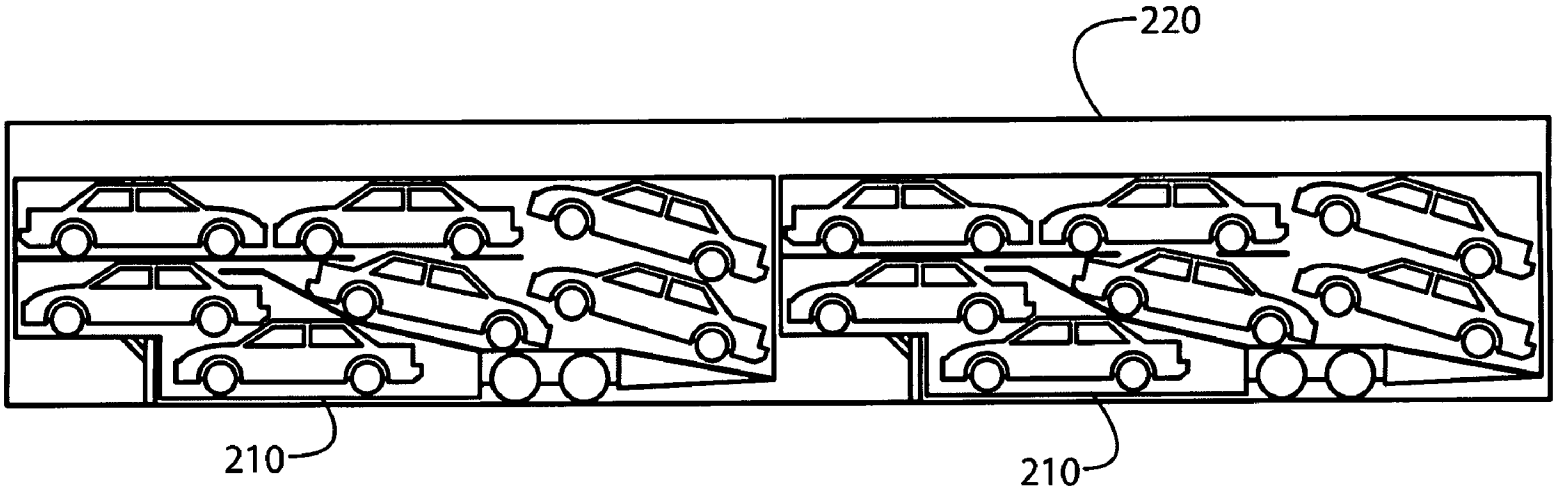
FIG. 11 is a side elevation view of autorack railcar and trailer employed within the system of FIG. 10 for hauling automotive vehicles.

Now in a particular reference to FIGS. 10-11, the present invention also contemplates a novel method of simplifying and expediting transport of finished auto vehicles from their assembly plants or marine import facilities to the dealer consignee by cutting cost, time, resources and manpower. One essential element of this method is incorporating the side 22 of the NLS cargo terminal 20 into the assembly plant 200, as best shown in FIG. 10, or marine import facility (not shown). Another essential element is providing special Auto Haulaway Trailers 210, each approximately forty-four (44) feet in length with a hauling capacity of up to seven (7) or possibly eight (8) automobiles per trailer. Yet another essential element is approximately ninety (90) foot long autorack railcars 220. Interior clearances will allow highway tractors to enter and drop special car-hauling trailers in a Roll-on-roll-off (RORO) operation. Two trailers 210 are end loaded onto a single autorack railcar 220. The trailers 210 will have specially designed Dower HD landing gears (not shown), which when lowered will serve as stanchions that will be mechanically anchored to the floor of the autorack railcar 220. The autorack railcar 220 will be docked to the NLS cargo terminal 20 in accordance with the above described embodiments. A mobile ramp (or stationary in some applications) will be utilized for driving the haulaways on and off the autorack railcar 220.

The intermodal method of the present invention for transporting automobiles has a number of advantages. The automakers can schedule direct shipment of automobiles for delivery throughout a continent, for example such as North America, to almost any dealers within a close geographical proximity to one another. The handling is significantly minimized because the automobiles are only loaded once on the trailers as they come off the assembly line and will never again be required to be driven, reloaded, transloaded, rechalked, or unloaded again until they arrive at the auto dealer's lot. The number of auto vehicle sorting facilities can be significantly reduced if not eliminated all together, reducing delivery costs including reduction in damage claims. It also provides for a seamless intermodal vehicle distribution network combining the advantages of what the truck and rail modes do best. The railroads will function as the least costly "Linehaul" operators, transporting vehicles over long distances. Trucking operations work best with pickup service, tracking and delivery service, and will operate at both ends of the rail linehaul. It is presently contemplated that, at the assembly plants and ports, the trucking companies will manage coordination with the manufacturer and make vehicle routing schedules and loading of auto vehicles onto trailers and the subsequent loading of trailers 210 onto the autorack railcars 220. Then after the transportation of auto vehicle by rail is completed, the tracking companies will be responsible for railcar offloading and final delivery to the dealers' locations as they presently perform this type of service. This combination of truck and rail service creates a simple and efficient Intermodal Auto Delivery (IAD) system with rail performing longer linehaul operations and trucks performing the scheduled loading and delivery services. Such intermodal auto delivery plan dramatically cuts handling resulting in freight costs savings as well as reduction in damage claims. Large auto rail facilities and present mixing centers operations would be less stressed and less utilized, cutting costs and possibly improving throughput. Rather large acreage lots dedicated for these facilities could then be used for other purposes. The transporting efficiency gained by the present invention is advantageous in maximizing profits, particularly, during slowdowns in vehicle purchases.

The present invention is also advantageous in a mixing center operation mode, where multiple vehicle models arrive from assembly and/or port facilities via conventional autorack train consists. The auto vehicles may be then off-loaded for mixing and trans-loading onto Intermodal Autohauler trailers, and then onto Intermodal Autorack railcars for final disbursement throughout the continent. It would be appreciated that inbound and outbound cargo terminals 20 may be located in almost any rail yard on the continent. The only essential requirement would be a secure and preferably lighted area of the yard. IAD facility can be selected from any of the available rail yards. Each IAD operation could be located within a very small section of almost any rail yard across the country. Presently, there are only approximately 256 vehicle handling sites across North America that have rail auto ramp capability. Most of these sites are at assembly plants and ports that are not in ideal locations for forming an effective distribution network. Almost all are concentrated in just a few states, and, in many instances, they are located adjacent to each other. The IAD "end terminals" will have strategic capability, in that, they can be closed and relocated quickly and with little cost. The only principal piece of equipment, the mobile ramp can be loaded onto a flatcar or truck and transported to a new rail yard within a day or two.

The IAD system would open new business opportunities for the railroads by having the total rail linehaul mileages of autorack freight substantially increased. The railroads in the face of an opportunity to gain in vehicle delivery market share might be willing to classify this newly expanded business as priority-expedite in regard to linehaul throughput speed, exchange speed between companies and within the rail cargo terminals. The higher the overall rail linehaul speed, the better the entire system functions and the more everyone benefits.

The IAD system may create a new niche market for the trucking industry by way of efficient trucking operations that manage auto vehicle transport through the procedures of improved freight planning, express loading, in-route tracking and final delivery to their dealers and customers. The IAD system by combining the best operational aspects of truck and rail is the key to dramatic change. Better intermodal cooperation, coupled with cheaper, quicker modal exchanges and communications procedures will lead to the efficiencies that the Auto Industry has been seeking for their products freight movements. When the auto manufacturers find sufficient savings using the IAD System, they might be receptive to assuming a portion or all of the back-haul charges for restaging empty haulaway trailers. As the IAD System network grows, the options of shorter backhauls to reach a port or assembly plant will improve the empty mile situation associated with back haul of empty trailers.

Furthermore, as Internet auto purchasing has gained wide acceptance, many buyers are impatient to be in possession of their new vehicle. They have little concern for freight cost as long as their vehicle is delivered quickly and undamaged. The IAD system can meet these requirements.

It would be appreciated that an Information Technology System will be utilized for scheduling automobiles to load and routing plans. By way of one example, Information Technology System will function as follows: 1) Each auto vehicle will be assigned on a loading plan of a haulaway trailer. 2) The trailer will then be scheduled onto an Autorack railcar. 3) A railroad routing plan will be scheduled to linehaul the railcar to the nearest rail terminal of the purchasing dealerships. 4) At the outbound rail cargo terminal, the trailer will be offloaded by a driver and tractor with dispatch instructions to haul the trailer to the dealer(s) for automobile delivery. The entire freight plan, from loading to transporting and delivery will be synchronized into a single intermodal plan that will provide for a quicker and more efficient delivery to the dealership.

Finally, the use of the conventional autorack unit trains would be reduced. Intermodal autorack cars would move independently or in shorter consists on mixed trains, making them more geographically dispersed to greater numbers of terminals. Optional GPS tracking may be utilized in order to help maintaining control of this situation. An IAD railcar would not be dispatched without containing two IAD trailers either empty or loaded.

Although the present invention has been shown in terms of the end loaded NLS boxcars 4 and autorack railcar 220, it will be apparent to those skilled in the art, that the present invention may be applied to end loaded well cars as disclosed in the related U.S. Utility patent application Ser. No. 12/406,531 filed Mar. 18, 2009 and whose teachings are incorporated into this document by reference thereto.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art without departing from the spirit and scope of the invention as set forth in the appended claims.

We claim:

1. A system for transporting cargo, said system comprising:

(a) a cargo terminal having a pair of longitudinal sides, at least one of said pair of longitudinal sides disposed adjacent to and spaced a predetermined distance from a railway track; and (b) means for positioning longitudinal sides of at least one railcar at a predetermined angle relative to said at least one of said pair of longitudinal sides of said cargo terminal and positioning one end of such at least one railcar in close proximity thereto so as to enable loading or unloading such cargo through such one end of such at least one railcar, said positioning means includes at least one straight track portion and means for moving said at least one straight track portion between a first position wherein said at least one straight track portion is aligned with such railway track and a second position wherein said at least one straight track portion is disposed at said predetermined angle.

2. The system, according to claim 1, wherein said system includes a predetermined plurality of docks disposed within said at least one of said pair of longitudinal sides of said cargo terminal in alignment with such one end of said at least one railcar disposed at said predetermined angle.

3. The system of claim 1, wherein said means for moving said at least one straight track includes at least one powered operator operable to generate linear motion.

4. The system of claim 1, wherein said means for moving said at least one straight track includes a pair of base members and a pair of powered operator operable to generate linear motion, each of said pair of base members positioned adjacent one end of said at least one straight track, wherein said at least one straight track is supported on said pair of base members, each of said pair of powered operator attached to said each of said pair of base members.

5. A system for transporting cargo, said system comprising:

(a) at least one railcar having a pair of longitudinal sides and a pair of end doors;

(b) a cargo terminal having at least one longitudinal side disposed adjacent to and spaced a predetermined distance from a railway track;

(c) a predetermined plurality of docks disposed within said at least one longitudinal side of said cargo terminal; and (d) a railway switch assembly positioning said longitudinal sides of said at least one railcar at a predetermined angle relative to said at least one of said pair of longitudinal sides of said cargo terminal and positioning one end of said at least one railcar in close proximity thereto and in alignment with one of said predetermined plurality of docks so as to enable loading or unloading such cargo through said one end of said at least one railcar.

6. The system, according to claim 5, wherein said system includes at least one curvilinear track branch having one end thereof positioned in close proximity to said cargo terminal and having an opposed end thereof connected by said railway switch assembly to suck railway track.

7. The system, according to claim 5, wherein said system includes an automatic guiding vehicle system disposed within said cargo terminal and wherein such at least one railcar includes a pair of tracks disposed within floor structure thereof for enabling reciprocal inward and outward movement of automatic guiding vehicle relative to an interior portion of such at least one railcar.

8. The system of claim 7, wherein said system further includes a pair of tracks disposed within said cargo terminal in operative alignment with said pair of tracks disposed within floor structure of said at least one railcar so as to allow movement of an automatic guiding vehicle between interiors of said cargo terminal and said at least one rail car.

9. The system, according to claim 5, wherein said cargo terminal includes a predetermined plurality of second docks disposed in an opposed on of said pair of longitudinal sides of said cargo terminal for receiving one of at least one railcar and at least one trailer positioned at a second predetermined angle.

10. The system, according to claim 5, wherein said cargo terminal includes a predetermined plurality of third docks disposed in one end of said cargo terminal.

11. The system, according to claim 5, wherein said cargo terminal includes a predetermined plurality of staging areas, each of said predetermined plurality of staging areas disposed between a pair of adjacent railcars.

12. The system, according to claim 5, wherein said at least one railcar is an autorack railcar and said system includes a pair of automotive vehicle carrying trailers sized to fit within the interior space of said autorack railcar.

13. The system of claim 5, wherein said at least one railcar further having apparatus connected to each of said pair of end doors, wherein said each of said pair of end doors is movable between a closed position wherein said each of said pair of end doors is disposed generally vertical for closing a respective end of said at least one railcar and an open position wherein said each of said pair of end doors is disposed generally horizontal above a roof structure of said at least one railcar.

14. An intermodal network for transporting cargo, said network comprising:

(a) a first cargo terminal having a pair of longitudinal sides, at least one of said pair of longitudinal sides disposed adjacent to and spaced a predetermined distance from a railway track;

(b) a second cargo terminal having a pair of longitudinal sides, at least one of said pair of longitudinal sides disposed adjacent to and spaced a predetermined distance from said railway track; and (c) means for positioning longitudinal sides of at least one railcar at a predetermined angle relative to said at least one of said pair of longitudinal sides of said each of said first and second cargo terminals and positioning one end of such at least one railcar in close proximity thereto so as to enable loading or unloading such cargo through such one end of such at least one railcar.

* * * * *